US005685622A

United States Patent [19]

Laakso

[11] Patent Number: 5,685,622

[45] Date of Patent: Nov. 11, 1997

[54] CABINET DRAWER INTERLOCKING SYSTEM

[75] Inventor: Roger Laakso, Medfield, Mass.

[73] Assignee: Lista International Corporation, Holliston, Mass.

[21] Appl. No.: 598,364

[22] Filed: Feb. 8, 1996

Related U.S. Application Data

[63] Continuation-in-part of Ser. No. 388,623, Feb. 14, 1995, Pat. No. 5,605,388.

[51] Int. Cl.[6] ..... E05B 65/46; E05C 7/06

[52] U.S. Cl. ..... 312/221; 312/218; 312/216

[58] Field of Search ..... 312/216, 217, 312/218, 219, 220, 221, 222

[56] References Cited

U.S. PATENT DOCUMENTS

| | | | |
|---|---|---|---|
| 2,719,770 | 10/1955 | Roberts | 312/221 |
| 2,873,159 | 2/1959 | Becker | 312/219 |
| 3,874,755 | 4/1975 | Hegg et al. | 312/221 |
| 4,057,306 | 11/1977 | Resch, Jr. | 312/218 |
| 4,298,236 | 11/1981 | Laroche | 312/216 X |
| 4,352,529 | 10/1982 | Steinke | 312/222 |
| 4,394,056 | 7/1983 | Janke | 312/216 |
| 4,429,930 | 2/1984 | Blouin | 312/216 |
| 4,452,498 | 6/1984 | Wood, Jr. et al. | 312/216 |
| 4,480,883 | 11/1984 | Young | 312/216 X |
| 4,732,434 | 3/1988 | Hartrum | 312/221 |
| 4,804,876 | 2/1989 | Lannert et al. | 312/221 |
| 4,957,334 | 9/1990 | Lasko | 312/219 X |
| 4,993,784 | 2/1991 | Dana et al. | 312/221 |
| 5,056,877 | 10/1991 | Westwinkle | 312/217 X |

FOREIGN PATENT DOCUMENTS

| | | | |
|---|---|---|---|
| 153910 | 10/1953 | Australia | 312/218 |
| 2446620 | 9/1980 | France | 312/220 |
| 2 560 022 | 8/1985 | France . | |
| 2560022 | 8/1985 | France | 312/221 |
| 355366 | 6/1922 | Germany . | |
| 1 903 282 | 7/1970 | Germany . | |
| 31 09 842 A1 | 11/1982 | Germany . | |
| 3916973 | 11/1989 | Germany . | |
| 88353 | 7/1921 | Switzerland . | |
| 2127091 | 2/1984 | United Kingdom | 312/221 |

*Primary Examiner*—Peter M. Cuomo
*Assistant Examiner*—Robert J. Sandy
*Attorney, Agent, or Firm*—Cesari and McKenna, LLP

[57] ABSTRACT

A storage cabinet with a plurality of drawers has an interlocking mechanism which prevents more than one drawer being opened at any time. A vertical U-shaped support rail is located in the back of the cabinet, and vertical locking bars are disposed therein. Each locking bar pivots between two angular positions, and at least one shuttle mounted in the support rail confines the locking bars to a restricted range of pivoting, and requires that their pivoting be simultaneous. A spring bias on the shuttle forces the locking bars into one of two spring-biased pivot positions. In a first position, all the drawers are closed, and are free to be opened. The opening of a drawer causes a camplate attached to the drawer to shift the locking bars from the first pivot position to the second pivot position. In the second position, the unopened drawers are locked due to the obstruction of the camplates of the unopened drawers by one of the locking bars. Upon the opened drawer being closed, the camplate of the open drawer engages the locking bars and moves them back to the first pivot position, thereby removing the obstruction. Side supports of the camplates reinforce the stress on the support rail caused by deflection of one of the locking bars when a drawer is pulled on while in the locked position. A single cabinet locking mechanism and a gang-locking mechanism are also provided to allow manual cabinet locking.

9 Claims, 12 Drawing Sheets

CABINET DRAWER INTERLOCKING SYSTEM

RELATED APPLICATIONS

This application is a continuation-in-part of application Ser. No. 08/388,623, filed Feb. 14, 1995, U.S. Pat. No. 5,605,388 entitled "CABINET DRAWER INTERLOCKING SYSTEM."

BACKGROUND OF THE INVENTION

1. Field of the Invention

This invention relates to the field of storage cabinets and, more specifically, to storage cabinets with drawer interlocking mechanisms that prevent the simultaneous opening of more than one cabinet drawer.

2. Description of the Related Art

The benefits of having an interlocking mechanism on a cabinet of drawers which prevents more than one drawer from being opened at the same time has long been recognized. Without such a mechanism, the opening of two drawers could move the center of gravity of the cabinet forward to the point that the cabinet tips over. Because this would most likely occur as a drawer was being opened, the danger of having the cabinet fall forward onto a person opening the drawer is high.

One type of locking system which prevents more than one drawer from being opened at a time uses a vertical, rectangular latch bar at the rear of the cabinet which is pivotable about one of its vertical sides. Each of the drawers has a cam plate affixed to its rear surface. The vertical bar is typically spring-biased such that it remains in one of two angular positions between which it can pivot.

With the cabinet drawers in the closed position, the bar is adjacent to the cam plate of each drawer in a first angular position. As one of the drawers is opened, a camming surface of the cam plate of the drawer being opened engages the vertical bar and pivots it past a centerpoint of its spring bias. This camming action is sufficient to move the bar to a second angular position. In this second position, the bar is still adjacent the cam plates of the unopened drawers, but physically obstructs the cam plates of the closed drawers such as to prevent their being opened. When the opened drawer is closed, a second camming surface of the cam plate engages the vertical bar and pivots it back to the first angular position, in which the bar no longer obstructs the opening of the other drawers.

Each of the drawers of this prior art cabinet engages the vertical bar in the same manner, such that the opening of any of the drawers results in the pivoting of the bar and the locking of the other drawers. Although this design is somewhat effective, it suffers from some problematic side effects. Because the vertical bar is the element which must restrict the opening of the locked drawers, it is necessary to make it sturdy enough to resist the force of someone yanking on a locked drawer. In addition, because the bar must be free to pivot along its entire length, it is generally connected only at the top and bottom of the cabinet. Thus, for a relatively large cabinet, the bar may be up to six feet long, and must resist lateral forces from the drawers with support only at its two ends. For this reason, the bar is made out of a relatively high-gauge metal, typically steel.

Because the locking bar described above is made of a heavy, sturdy material, it has a significant amount of inertia. As a result, a problem occurs when one of the cabinet drawers is slammed shut. The slamming of the drawer causes the cam plate of the open drawer to strike the vertical bar with a great deal of force which, in turn, causes the bar to pivot with a relatively high angular velocity. When the bar reaches the second pivot position, the inertia of the heavy bar causes it to bounce back against the force of the spring bias. If the drawer is slammed hard enough, the bar bounces back to the position typically occupied only when one of the drawers is opened. Instead, however, the drawer which was slammed shut is in the closed position, along with the others, and the position of the bar obstructs the cam plates of all of the drawers, preventing any of them from being opened.

The "lock-up" situation described above is a problem which has plagued cabinets which use this type of design. In a cabinet which also has a key lock, this "lock-up" situation can be remedied by turning the key in the lock to return the bar to its unlocked position. However, if the key happens to be in one of the drawers, as is often the case, or is otherwise unavailable, a cabinet owner who suffers from this problem must wait for a trained service person to travel to the site of the cabinet and correct the problem. In the interim, materials inside the cabinet drawers are inaccessible. Because of the risk of this problem, there has been reluctance to use this type of cabinet design for industries where access to the contents of the drawers may be of critical importance, such as the medical industry.

SUMMARY OF THE INVENTION

The present invention provides a multi-drawer storage cabinet having a drawer interlocking system which prevents the opening of more than one drawer at a time. The cabinet has a first vertical locking bar and a second vertical locking bar, the motion of which are linked by at least one shuttle. The shuttle has two notches, each of which receives a first side of one of the locking bars. The shuttle is supported by a vertical, substantially U-shaped support rail which is attached to the back of the cabinet. The support rail also includes two vertical notches, each of which receives a second side of one of the locking bars.

The confinement of the locking bars by the support rail and the shuttle is such that lateral motion of the locking bars is restricted. However, the bars are free to pivot about their second sides over a limited range. The shuttle links the pivoting of the two locking bars such that they pivot in unison between a "locked" position and an "unlocked" position. The pivoting of the locking bars results from engagement by any one of a plurality of camplates, each of which is rigidly affixed to the back of one of the drawers of the cabinet. Each camplate has a first camming surface and a second camming surface which engage the locking bars and force them to pivot between two extreme angular positions. A shuttle spring biases the shuttle to one of the two extreme angular positions which may be occupied by the locking bars, and thereby renders angular positions between those two extremes unstable.

When one of the drawers is moved from a closed position to an open position, the first camming surface of the camplate attached to that drawer engages the second locking bar, forcing it from the unlocked position to the locked position. Because the motion of the locking bars is linked via the shuttle, the first locking bar also pivots from the unlocked to the locked position. In the locked position, the first locking bar obstructs a locking surface of each of the closed drawers. Each locking surface is preferably an integral part of the camplate of its respective drawer. With its locking surface obstructed by the first locking bar, opening of the drawer is prevented.

When the open drawer is moved from the open position to the closed position, the second camming surface engages the first locking bar, forcing it to pivot from the locked position to the unlocked position. The linkage between the two locking bars (via the shuttle) causes the second locking bar to also move from the locked position to the unlocked position. In the unlocked position, the first locking bar no longer obstructs the locking surface of the closed drawers, and any one of the drawers may be opened.

The support rail of the present invention provides support to each locking bar along its entire length. That is, in the direction of the pivot axis of each bar, the rail supports not only the end portions of the bar, but also an intermediate portion between the two ends. This is because rather than being secured at the top and bottom (as is typical in prior art pivoting bars), the locking bars of the present invention are supported along their entire length, one side of each bar being cradled in a notch of the support rail. The cradled surface of each bar is curved, and has a radius of curvature smaller than that of an inner curved surface of the notch in which it resides. Thus, each bar is free to pivot within the notch, while still receiving the support of the rail along its entire length.

Reinforcement of the locking bars is also provided by support surfaces attached to the drawers, which are preferably integral with the camplates. Each drawer has at least a first support surface which, when the drawer is closed, resides adjacent to the first locking bar. If a user of the cabinet yanks on one of the closed drawers when another drawer is open, the first locking bar could possibly deflect due to force translated to the first bar from the camplate of the drawer being yanked. However, any significant deflection is restricted by the adjacent support surfaces, which obstruct any deflection of the first locking bar beyond a particular point.

Each drawer may also have a second support surface which, when the drawer is closed, is located adjacent to a side of the support rail opposite the first support surface. If the pulling force on the drawer is great enough to deflect the first locking bar and to move the first support surface (and the drawer to which it is connected) laterally, the motion of the drawer causes the second support surface to contact the opposite side of the support rail. This prevents any further lateral motion of the drawer and, consequently, prevents any further deflection of the first locking bar.

The present invention is also provided with a locking mechanism which is movable between a locked (or "secured") position and an unlocked (or "unsecured") position. In one form of the invention, the locking mechanism includes a rotor fixedly secured to the lock rod and a pivot block pivotally secured to the support rail via a base plate. The pivot block includes an integral extended locking surface adjacent to the second locking bar and an integral extended contact arm adjacent to the first locking bar. Fixedly secured to the top surface of pivot block is an engagement block, preferably a tapered cylinder, through which, in conjunction with the rotor, the rotational movement of the lock bar is translated into the pivotal movement of the pivot block.

As the locking bar is rotated counterclockwise, the rotor contacts the cylinder, forcing the pivot block to pivot counterclockwise about its pivot point and causing the extended locking surface to contact the second locking bar, forcing it to travel to its adjacent support rail and into its locked position. The first locking bar also travels to its locked position. When the locking bar is rotated clockwise, the rotor contacts the cylinder, forcing it to pivot clockwise about its pivot point. As it rotates, the integral extended contact arm briefly contacts the first locking bar, forcing it to pivot to its unlocked position, and causing the extended locking surface to travel away from the second locking bar, thereby enabling it to travel with the first locking bar. When the lock bar reaches its locked position it is no longer in the path of the extended contact arm. As the pivot block continues to pivot, the extended arm moves behind the lock bar, allowing the lock bar to travel between its locked and unlocked position as drawers are opened and closed.

In another form of the invention, when the locking mechanism is moved to the locked position, a biasing spring is forced into contact with a locking pin of the shuttle, and biases the shuttle (and correspondingly the locking bars) toward the locked position. If an open drawer is then moved to the closed position, the force of the camplate of that drawer engaging the first locking bar is sufficient to temporarily move the locking bars (and shuttle) to the unlocked position against the bias of the biasing spring. However, once the drawer is completely closed, and the force from the camplate on the first locking bar is removed, the biasing spring forces the shuttle and locking bars back to the locked position. Only by moving the locking mechanism to the unlocked position, which forces the shuttle and locking bars back to the unlocked position, can the drawers again be opened.

A gang-locking system is also provided which allows a plurality of adjacent cabinets using the drawer interlocking system of the present invention to be simultaneously locked and unlocked. In one form of the invention, the ganglock system includes one or more actuating rods pivotally attached to one or more coupling plates secured to an associated pivot block. When the gang-locking mechanism is in an unlocked position, the drawers of the cabinets may be opened and closed, subject only to the drawer interlocking mechanism of each of the cabinets. To gang-lock the cabinets, the actuator applies a force on an actuating rod, causing it to move in such a manner that, through the coupling plates, causes the pivot block to rotate clockwise about its pivot point to eventually cause it, and its associated lock bars, to arrive at their locked position. This force is transferred to all ganged cabinets, causing them to simultaneously lock in the same manner. To unlock the cabinets, the actuator is used to move the actuating arms in such a manner to cause the pivot blocks to rotate in a counterclockwise direction into their respective unlocked positions.

In another form of the invention, an actuator, when engaged, moves a linkage which connects a plurality of gang-locking shuttles, each of which is mounted in the support rail of one of the cabinets. Each gang-locking shuttle, when moved to a locked position, contacts a drawer interlock shuttle of its cabinet, and forces it (and the locking bars) to a locked position. Since the gang-locking shuttles are interconnected, the locking of all the cabinets may be accomplished with a single actuator. When the actuator is disengaged, the linkage returns to its original position, and the gang-locking shuttles contact the drawer interlock shuttles and force them back to the unlocked position.

In the present invention, the support provided along the entire length of the locking bars by the support rail, and the reinforcement of the support surfaces provides a sturdy design which reduces reliance on heavy gauge materials. By using lighter gauge materials for the locking bars, the cabinet, while retaining its resistance to the forcible opening of locked drawers, is lightweight and inexpensive to manufacture. In addition, the locking bars do not have the high inertia of prior art locking bars, and therefore do not suffer from the "lock-up" phenomenon common in prior art cabinets. Finally, the lightweight materials require less force to move the locking bars between the locked and the unlocked positions, and are therefore well-suited to electrically-actuated locking mechanisms, such as those using RF decoders or magnetic card readers. A solenoid actuator used with such systems can be relatively small in size, and have a low rate of power consumption.

DETAILED DESCRIPTION OF A PREFERRED EMBODIMENT

Figure 1:
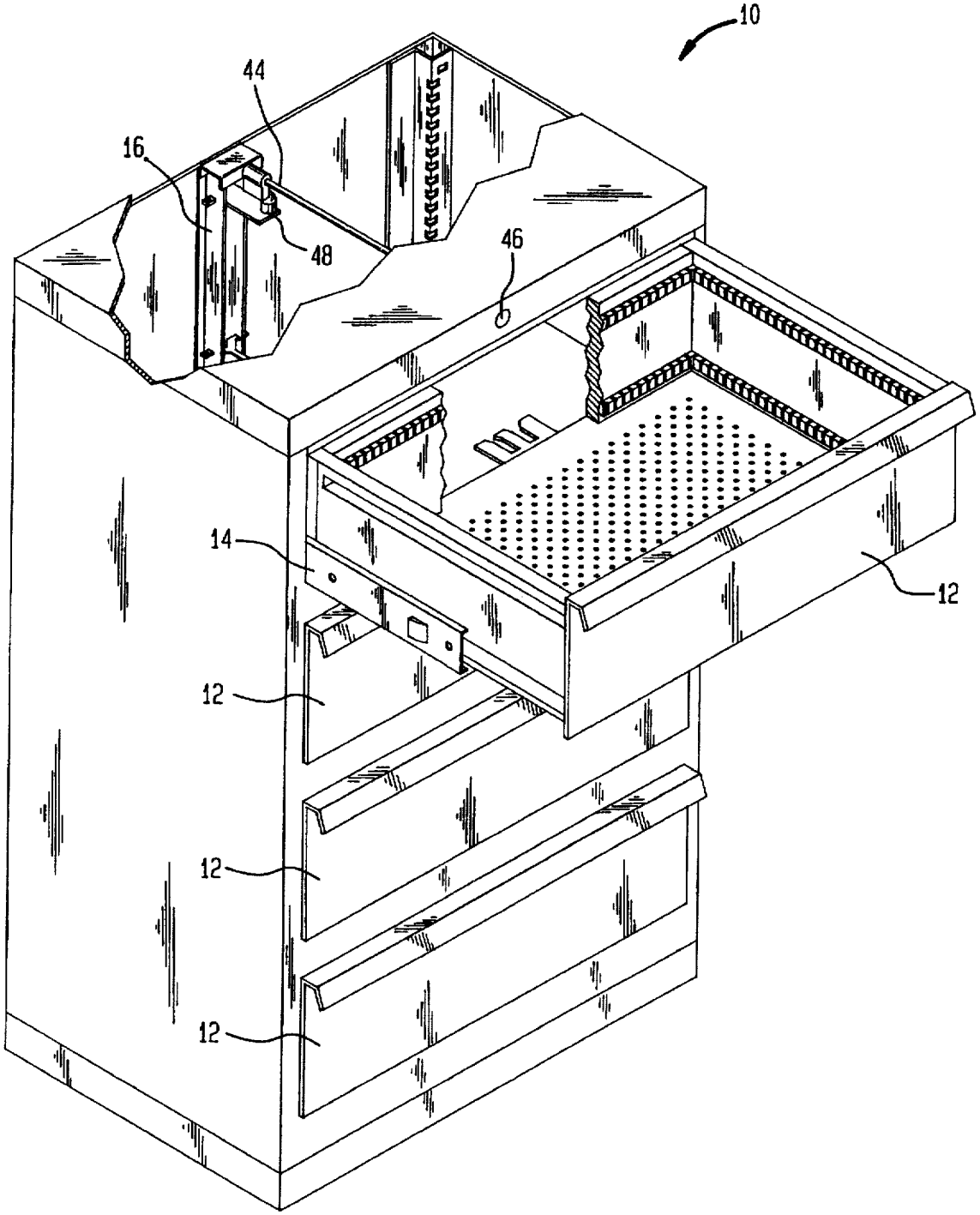
FIG. 1 is an isometric view of a storage cabinet having a drawer interlocking mechanism according to the present invention.

Shown in FIG. 1 is a cabinet 10 having a plurality of sliding drawers 12 in which material may be stored. Each drawer slides in and out of cabinet 10 along two drawer guides 14, as is well known in the art of cabinet making. In accordance with the present invention, the cabinet 10 includes a drawer interlocking mechanism which prevents the opening of more than one drawer at any time. This mechanism thus prevents the relocation of a center of gravity of the cabinet from being moved so far forward that it causes the cabinet to tip over. The cabinet of FIG. 1 is shown with four drawers, but it will be understood by those skilled in the art that the invention is equally applicable to cabinets having any number of vertically arranged drawers.

The interlocking mechanism of the present embodiment comprises a vertical U-shaped support rail 16 within which are disposed two vertical locking bars 18A, 18B. These elements are more clearly shown in the isolated isometric view of FIG. 2A and the exploded isometric view of FIG. 2B. As shown in FIG. 1, the rail 16 is rigidly connected to a mounting bracket 11 (shown in FIG. 8B) on the back portion of the cabinet 10, and runs the vertical length of the cabinet 10. Referring to the exploded view of FIG. 8B, the rail is attached to the cabinet by sliding the slots (not shown) in the rail 116 over tabs 98 in the mounting bracket 11. The mounting brackets are attached to the top and bottom covers of the cabinet (not shown).

Figure 2A:
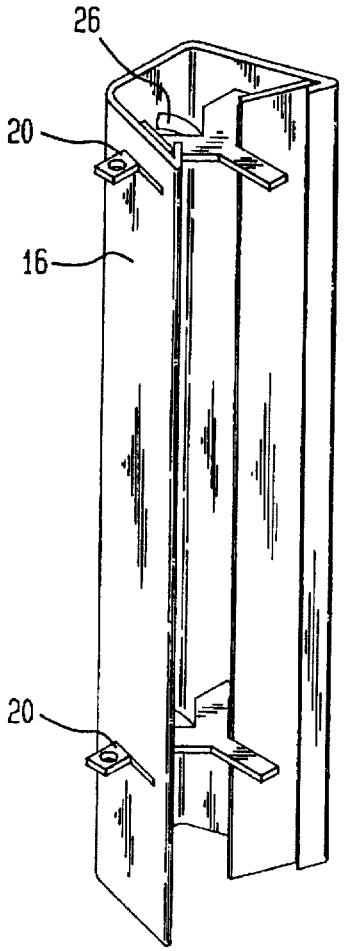
FIG. 2A is an isolated isometric view of a support rail of a storage cabinet of the present invention.
Figure 2B:
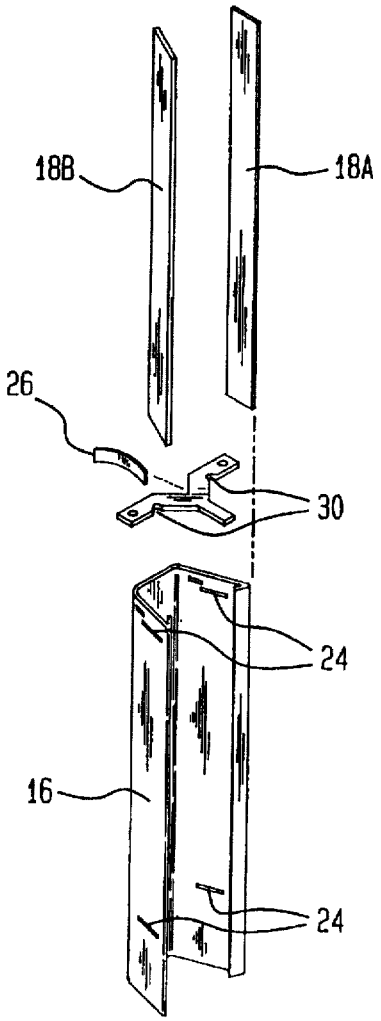
FIG. 2B is an isolated, exploded view of a support rail of the present invention.

Referring to FIGS. 2A and 2B, disposed vertically along the length of rail 16 are drawer interlock shuttles 20, which guide the movement of locking bars 18A, 18B. Each of the shuttles 20 passes through two opposing slots 24 in side portions of rail 16, and has two notches 30 for receiving vertical locking bars 18. The slots 24 are longer than the width of each shuttle 20, which allows some freedom of movement of the shuttles 20 as they reside in the slots 24. A flat spring 26 (preferably a flat, rectangular, steel leaf spring) is connected to each of the shuttles 20, providing a spring bias away from the back portion of rail 16. As will be described more fully below in connection with FIGS. 4–9, camplates 34 attached to drawers (not shown) slide into the interior volume defined by rail 16.

Figure 3A:
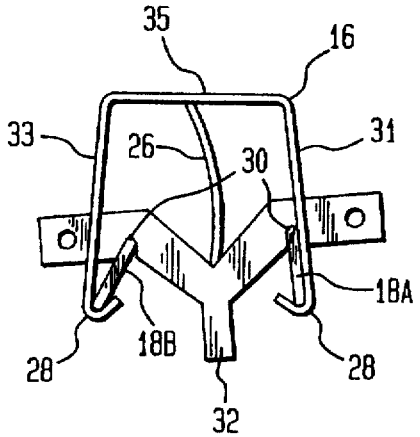
FIGS. 3A and 3B depict two relative orientations of an upper locking bar shuttle of a storage cabinet according to the present invention.
Figure 3B:
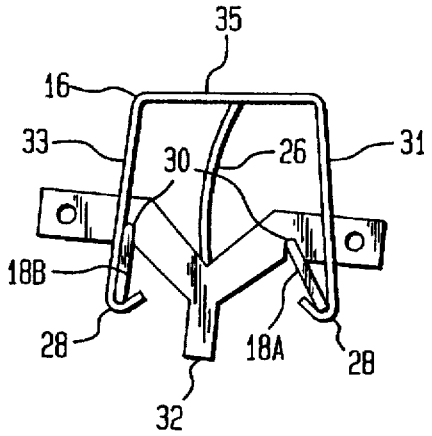

The manner in which the support rail 16, shuttles 20 and locking bars 18A, 18B interconnect may be understood from the cross-sectional top views of FIGS. 3A and 3B. As shown, each side portion of support rail 16 has a lip 28 which curls toward the inside of the "U-shaped" region. Each lip 28 provides a seat for one side of one of locking bars 18A, 18B and has an inner surface which cradles the outer surface of the bar which resides within it, thus allowing the bar to pivot along a vertical axis. The other side of each locking bar resides in one of the notches 30 in shuttle 20.

Because of the freedom of movement allowed in slots 24, and the bias of spring 26, each shuttle 20 resides in one of two orientations. FIGS. 3A and 3B demonstrate the relative orientation of the shuttle in the two limits of the spring bias. In FIG. 3A, locking bar 18A is shown parallel with and adjacent to a first side 31 of the support rail 16, while locking bar 18B is angled inward away from a second side 33 of the rail 16. In FIG. 3B, the relative positions of the locking bars 18A, 18B is reversed, with locking bar 18B lying adjacent to and parallel with second side 33 of the support rail 16, while locking bar 18A is angled inward away from side 31.

The oversized nature of slots 24 of support rail 16 allows a shuttle to reside in either of the two skewed positions shown, respectively, in FIGS. 3A and 3B. The spring 26 forces the shuttle 20 away from the back portion 35 of the support rail 16. However, the movement of the shuttle 20 is limited by the effective pivot points where the ends of locking bars 18A, 18B contact the shuttle, and where their opposite ends each contacts its respective lip 28 of support rail 16. The cocking of the shuttle 20 in either direction is limited by the surface-to-surface contact between either locking bar 18A and first side 31 of the support rail 16 or, in the other position, contact between locking bar 18B and second side 33 of support rail 16. Due to the bias of spring 26, shuttle positions between these two extremes are unstable.

In the preferred embodiment, each shuttle 20 has a spring 26. While a single spring 26 could be used to provide the necessary bias to all of the shuttles 20, this embodiment is not preferred. It will be understood that the movement of the shuttle 20 described in conjunction with FIGS. 3A and 3B is representative of the movement of all other shuttles 20.

The two orientations of the shuttle shown in FIGS. 3A and 3B correspond, respectively, to an "unlocked" and a "locked" position of locking bars 18A, 18B. In FIGS. 4 and 5A–5F, the shuttle is represented by a single dotted line between the locking bars 18, and is omitted from the figures to more clearly show the locking action of locking bars 18. Reference is made below to FIGS. 3A and 3B, for illustration of the two spring-biased extremes of the shuttles 20.

Figure 4:
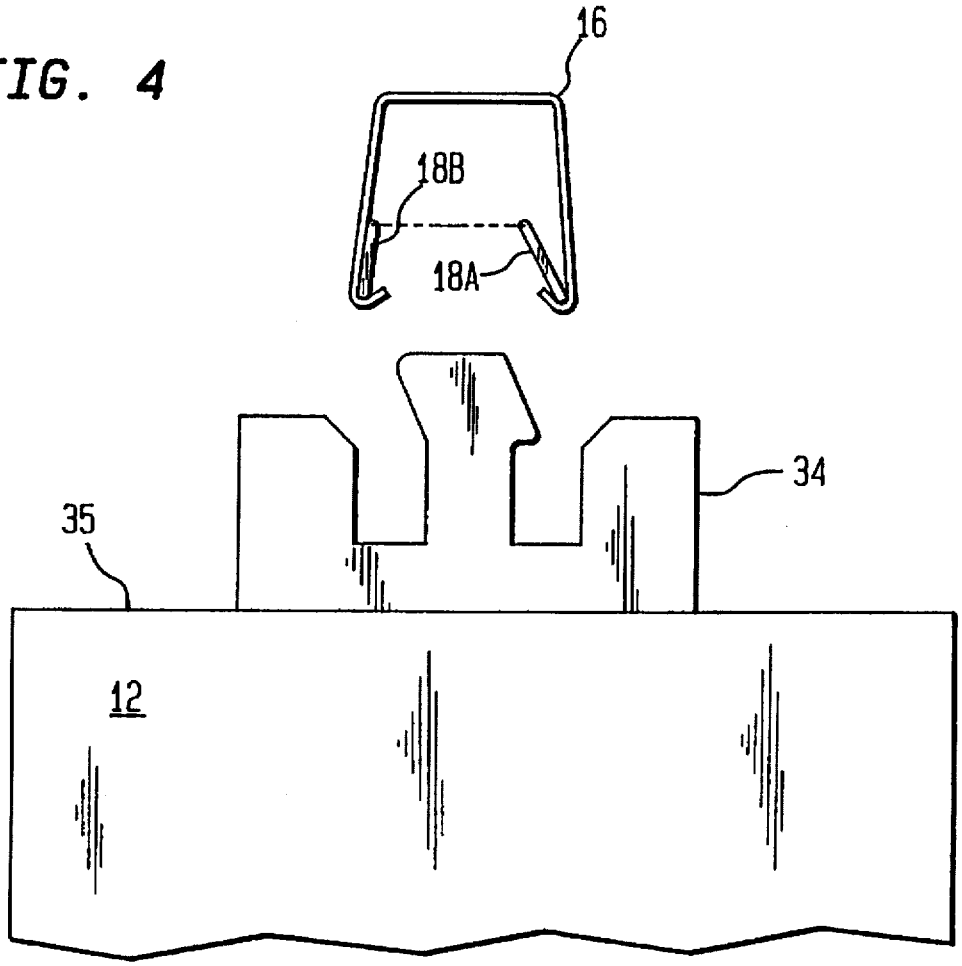
FIG. 4 is a schematic, cross-sectional top view of a drawer and a locking mechanism of storage cabinet according to the present invention.

Referring to the cross-sectional top view of FIG. 4, drawer 12 is shown with a camplate 34 rigidly attached to its back panel 35. Each drawer 12 is identical and has a camplate 34 which is positioned so that when the drawer 12 is closed (i.e. moved towards the back of cabinet 10) the camplate 34 engages the locking bars 18. The manner in which this interaction provides the interlocking feature of the present invention will now be described in detail while making reference to the figure sequence of FIGS. 5A–5F.

The camplate 34 of each drawer 12 contacts locking bars 18 in the same manner. Because each drawer 12 is at a different height, each camplate 34 contacts the bars 18 at a different location along their vertical length. It will be understood that for all the drawers 12 which are in the closed position in cabinet 10, the camplates 34 of those drawers are parallel to one another and aligned along a vertical axis of the cabinet 10. (See FIG. 2A).

Figure 5A:
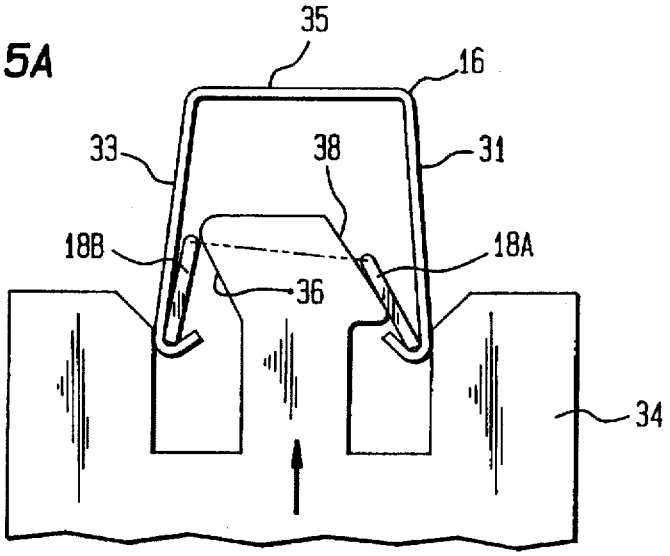
FIGS. 5A–5F are schematic depictions which show a sequence of relative positions between a camplate of a drawer and a locking mechanism of a storage cabinet of the present invention.
Figure 5B:
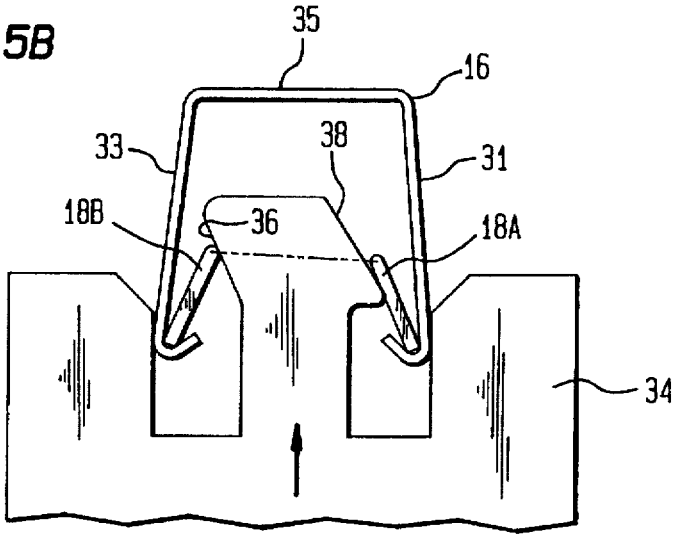
Figure 5C:
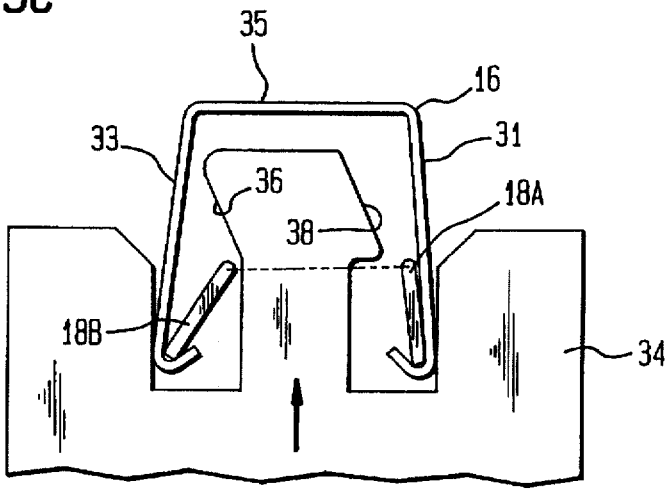

When one of the drawers 12 of the cabinet 10 is in an open position, the shuttles 20 are each in the orientation shown in FIG. 3B. Referring now to FIG. 5A, the contact between locking bars 18A, 18B and camplate 34 will be described. As the open drawer 12 is moved to a closed position (in the direction of the arrow shown in FIG. 5A), camming surface 36 narrowly passes the inside surface of locking bar 18B. Meanwhile, camming surface 38 engages the inside surface of locking bar 18A, displacing it towards first side 31 of support rail 16. Because the locking bars 18A, 18B are interconnected via the shuttles 20, the movement of locking bar 18A correspondingly moves locking bar 18B away from second side 33 of support rail 16, as shown in FIG. 5B. The two diagonal camming surfaces 36, 38 are arranged relative to each other to allow precise relative motion of locking bars 18A, 18B in this manner.

As shown in FIG. 5B, the progression of camming surface 38 against locking bar 18A further displaces it and, correspondingly, displaces locking bar 18B as well. The displacement of the bars 18A, 18B eventually reaches a point at which the bias of shuttle springs 26 forces the bars 18A, 18B to the position extreme shown in FIG. 3A. As camming plate 34 reaches the limit of its travel (which results from a travel limit of the drawer 12, as conventional in the art of drawer cabinets), the locking bars 18A, 18B are at rest in the position shown in FIG. 5C (and FIG. 3A). In this position, there is no impediment to the opening of any of the drawers 12 of the cabinet 10.

Figure 5D:
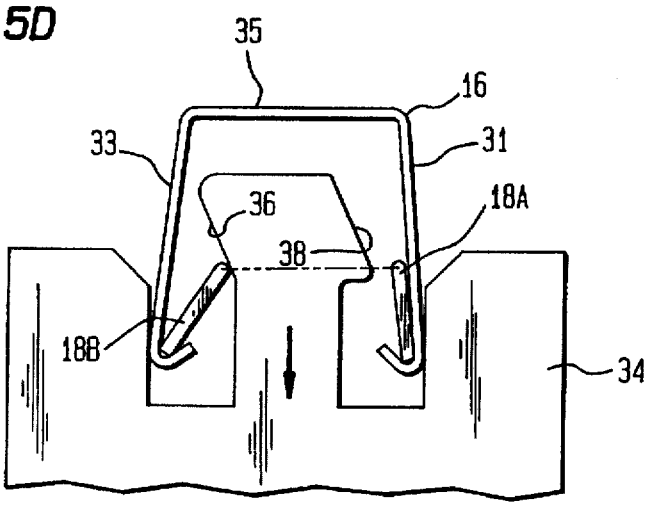
Figure 5E:
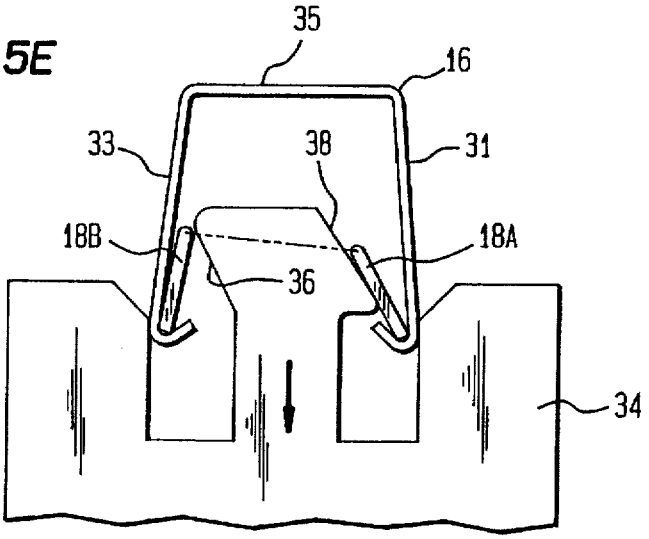
Figure 5F:
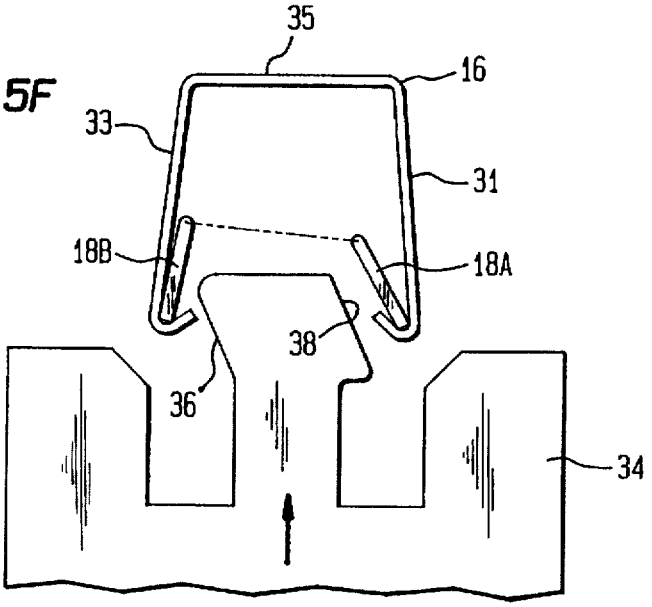

Referring to FIG. 5D, the opening of a drawer 12 (and corresponding movement of camplate 34) in the direction of the arrow shown, results in the camming surface 38 passing adjacent to locking bar 18A, and the engagement of camming surface 36 with locking bar 18B to rotate bars 18B and 18A in the counterclockwise direction. As shown in FIG. 5E, further motion of camplate 34 outwardly from back panel 35 results in camming surface 36 moving locking bar 18B (and, correspondingly, locking bar 18A) past a centerpoint of the bias of springs 26. Thus, the springs 26 force the bars 18A, 18B back to the position of FIG. 3B and FIG. 5E. Finally, as shown in FIG. 5F, when the camplate 34 of the drawer 12 is free of the locking bars 18A, 18B, the drawer 12 may be moved all the way outwardly to the open position. However, the movement of the locking bars 18A, 18B to the position shown in FIG. 3B restrains the drawers 12 remaining in the closed position.

Figure 6:
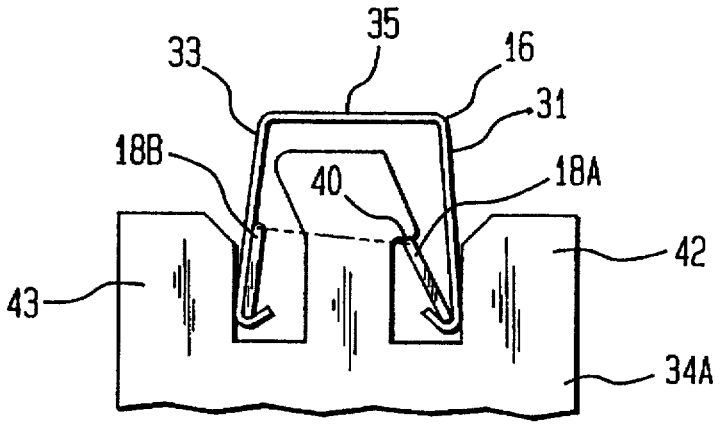
FIG. 6 is a schematic depiction of a locked position between a camplate of a drawer and a locking mechanism of a storage cabinet according to the present invention.

FIG. 6 shows a camplate 34A of a closed drawer and locking bars 18A, 18B after the camplate 34 of another drawer has moved the locking bars to the position shown in FIGS. 5F and 3B as a result of being opened. Locking bar 18A is, in this position, extended counterclockwise, i.e., angled inward away from support rail first side 31, and has its end located adjacent to notch 40 of camplate 34A. Any attempt to open the drawer connected to camplate 34A is prevented by the wedging of locking bar 18A between notch 40 and the lip 28 of support rail 16, in which the opposing end of locking bar 18A resides. Thus, until the open drawer is moved to the closed position, causing its camplate 34 to move the locking bars back to the "unlocked" position (as shown in the sequence of 5A–5F), the opening of the closed drawers is prevented.

Although support rail 16 is needed to support locking bars 18A, 18B and shuttles 20, it is not necessary that it be of a particularly high gauge (i.e., heavy) metal. In the preferred embodiment, the support rail is eighteen gauge steel. As shown in FIG. 6, side supports ("fingers") 42, 43 of camplate 34A are adjacent to the side portions 31, 33 of support rail 16, respectively. If a user of the cabinet applies excessive force trying to open a closed drawer 12 while one of the other drawers is open, the side portion 31 of support rail 16 deflects along with the support bar 18A, due to the force translated through notch 40. However, this deflection is impeded by the side portion 31 contacting the side support 42 of camplate 34A.

Because the drawers of the cabinet must have some side-to-side clearance to allow for their free movement, a certain degree of lateral freedom of movement usually exists for each of the drawers. Thus, a lateral force on the camplate 34A can cause the drawer to move laterally within the tolerance range. However, a significant shift of the camplate 34A in the direction of the side portion 31 deflection (i.e. to the right in FIG. 6) is also prevented by the obstruction of side support 43 by side portion 33 of support rail 16. Since the support rail is rigidly secured to the mounting bracket 11 which, in turn, is secured to the back portion of the cabinet, any significant shifting of the camplate 34A is prevented.

Because the side supports 42, 43 are flat, and the force applied to them is in a geometric plane in which they reside, the gauge of the camplate material 34, 34A, like that of the support rail 16, does not need to be particularly large. In the preferred embodiment, fourteen gauge steel is used to fabricate the camplates 34, 34A of the invention such that they are flat and parallel to one another when all drawers are in a closed position. The use of lower gauge metal material reduces the expense and weight of the components, therefore making the finished product lighter and less expensive to produce.

In addition to using light gauge material for shuttles 20, 20A, camplates 34, 34A and support rail 16, thirteen gauge steel is also preferably used for locking bars 18A, 18B. Unlike prior art devices, which typically support a locking bar at the top and bottom of the cabinet, locking bars 18A, 18B of the present invention are supported along their entire length, since they reside in lips 28 of support rail 16. Thus, a force on the bars due to yanking on a locked drawer is distributed along the length of the support rail 16. Given the added support from the side supports 42, 43 of each cam-plate 34A on a closed drawer 12, the gauge of locking bars 18A, 18B can be relatively low. As such, they do not have the inertia of high gauge prior art locking bars, and will not lock up from the slamming of an open drawer.

Figure 7C:
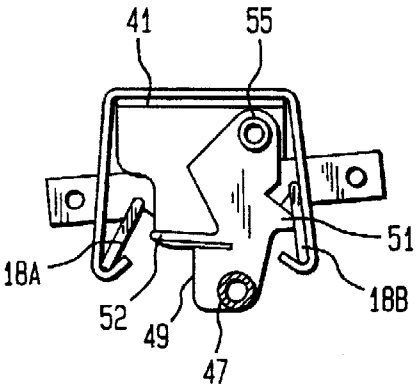
FIG. 7C is a top cross-sectional view of the preferred embodiment of the locking mechanisms of the present invention.
Figure 7B:
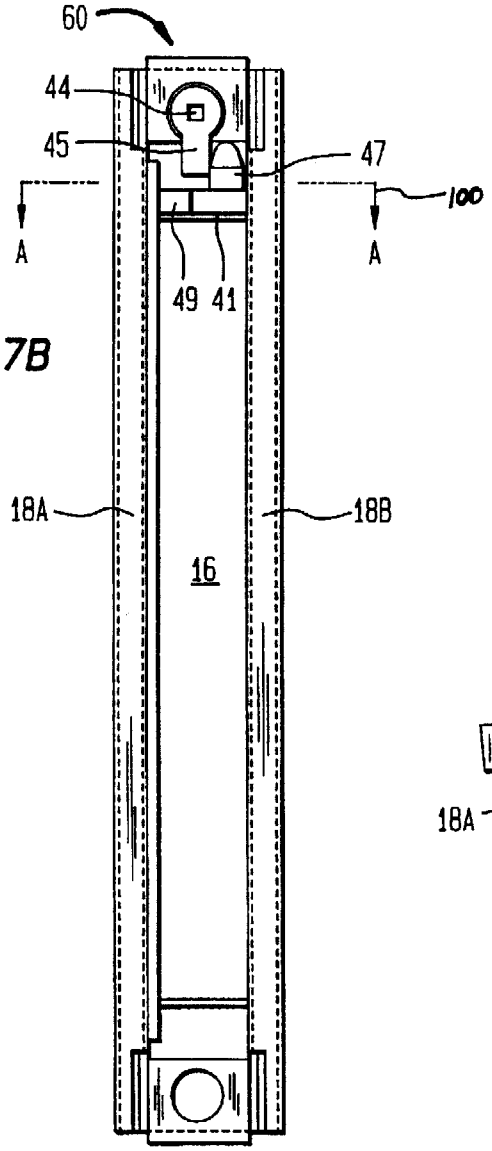
FIGS. 7A and 7B are, respectively, an isolated side view and an isolated front view of a preferred embodiment of a lock mechanism of a storage cabinet according to the present invention.
Figure 7A:
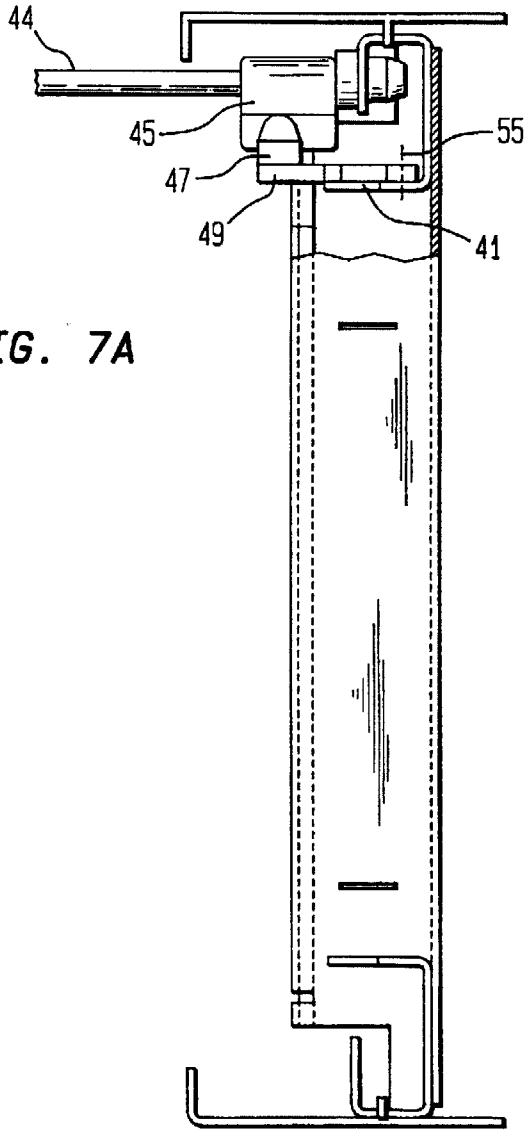
Figure 7F:
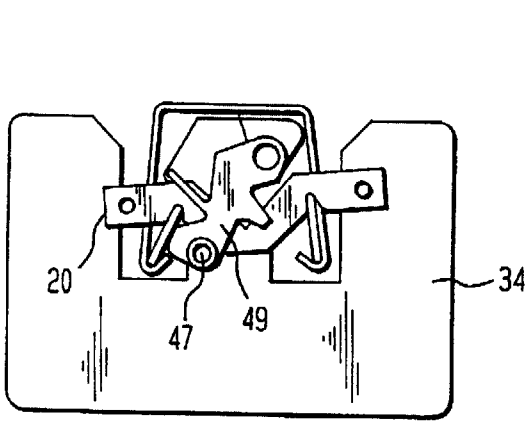
FIGS. 7D through 7F are top views illustrating the operation of the locking mechanism shown in FIGS. 7A–7C.
Figure 7E:
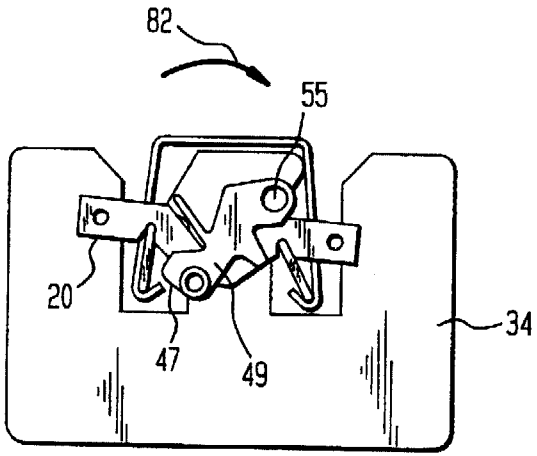
Figure 7D:
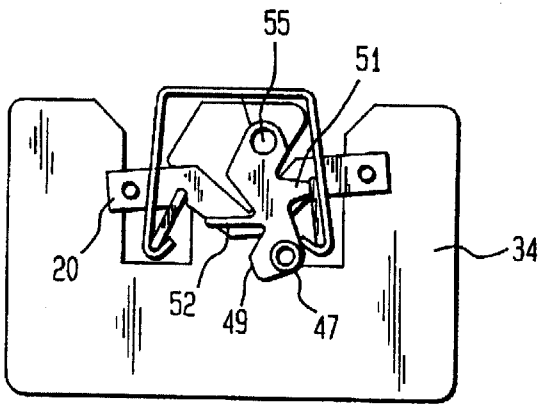

A locking mechanism is also provided with the present invention and may be understood in conjunction with FIGS. 7A through 7F. FIGS. 7A through 7C illustrate a preferred embodiment of the locking mechanism of the present invention. FIGS. 7A and 7B are isolated side and front views, respectively, of the preferred locking mechanism. FIG. 7C is a top view of the locking mechanism taken along section line A—A 100 of FIG. 7B. FIGS. 7D through 7F illustrate the operation of the preferred locking mechanism.

The locking mechanism generally includes a rotor 45 fixedly secured to a lock rod 44 that, when rotated in one direction causes the cabinet to lock; and when rotated in the opposite direction, causes the cabinet to unlock. A pivot block 49 is pivotally secured to a base plate 41 at pivot 55. The base plate 41 is secured to the support rail 16. The pivot block 49 includes an integral extended locking surface 51 adjacent to the second locking bar 18B and an integral extended contact arm 52 extending from the surface opposite the extended locking surface 51 and adjacent to the first locking bar 18A. Fixedly secured to the top surface of pivot block 49 is a tapered cylinder 47 through which, in conjunction with rotor 45, the rotational movement of the lock bar 44 is translated into the pivotal movement of the pivot block 49.

The relationship between the above components of the locking mechanism, as well as the operation of the locking mechanism with respect to the other components of the present invention, are described below with reference to FIGS. 7A through 7F. Note that in FIGS. 7D through 7F, the surfaces of the drawer cam are reversed as compared to the drawer cam illustrated above in, for example, FIGS. 4–6. This is the preferable orientation of the cam surfaces to maintain the proper rotation of the cylinder 46 to operate with the preferred locking mechanism without requiring additional hardware. However, as would be apparent by those skilled in the art, the drawer cams of FIGS. 7D–7F perform the same functions as the drawer cam described in detail above. It should also be noted that, in order to maintain consistency in the descriptions of each of the configurations, the lock bars 18A and 18B have also been reversed such that the first lock bar 18A, for example, continues to perform the same function regardless of the Figure in which it appears.

FIG. 7D illustrates the position of the pivot block 49 when it is positioned to completely secure or lock the cabinet with no draws opened. As the locking bar is rotated in the counterclockwise direction (i.e., in the direction of arrow 60 in FIG. 7B), rotor 45 contacts cylinder 47 forcing it to the right as shown in FIGS. 7B and 7D. As the pivot block 49 is pivoted counterclockwise about pivot point 55, the extended locking surface 51 contacts the second locking bar 18B, forcing it to travel to its adjacent support rail 16. The first locking bar 18A travels with the second locking bar in the manner described above. In the fully secured (locked) position, the extended locking surface 51 maintains the second locking bar in contact with the support rail, placing the first locking bar 18A in its outwardly extending, or locked position. As described above, when the locking bar 18A is in this locked position, no drawers can be opened due to the locking surface of each drawer being obstructed by the first side of the first vertical locking bar.

FIG. 7E illustrates the position of the pivot block 49 when it is positioned such that the cabinet is unsecured (unlocked), with all the drawers in the cabinet closed. When the cabinet is in the secured position (FIG. 7D), and the locking bar is rotated clockwise, rotor 45 contacts cylinder 47 forcing it to pivot clockwise about pivot point 55. As it rotates, the integral extended contact arm 52 briefly contacts the first locking bar 18A, forcing it to pivot to its unlocked position against support rail 16. As the pivot block 49 pivots clockwise, the extended locking surface 51 travels away from the second locking bar, enabling it to travel with the first locking bar in the manner described above. When the lock bar 18A reaches its locked position it is no longer in the path of the extended contact arm 52. As the pivot block 49 continues to pivot clockwise, the extended arm 52 moves behind the lock bar, allowing the lock bar 18A to travel between its locked and unlocked position as drawers are opened and closed.

FIG. 7F illustrates the cabinet unlocked with one drawer opened. The pivot block 49 in the same position as in FIG. 7E. However, as described above, when a drawer is opened the locking bars are forced into the locked position. The location of the contact arm 52 of pivot block 49 is behind the locking bar, allowing the locking bar to shift from side to side.

Figure 7G:
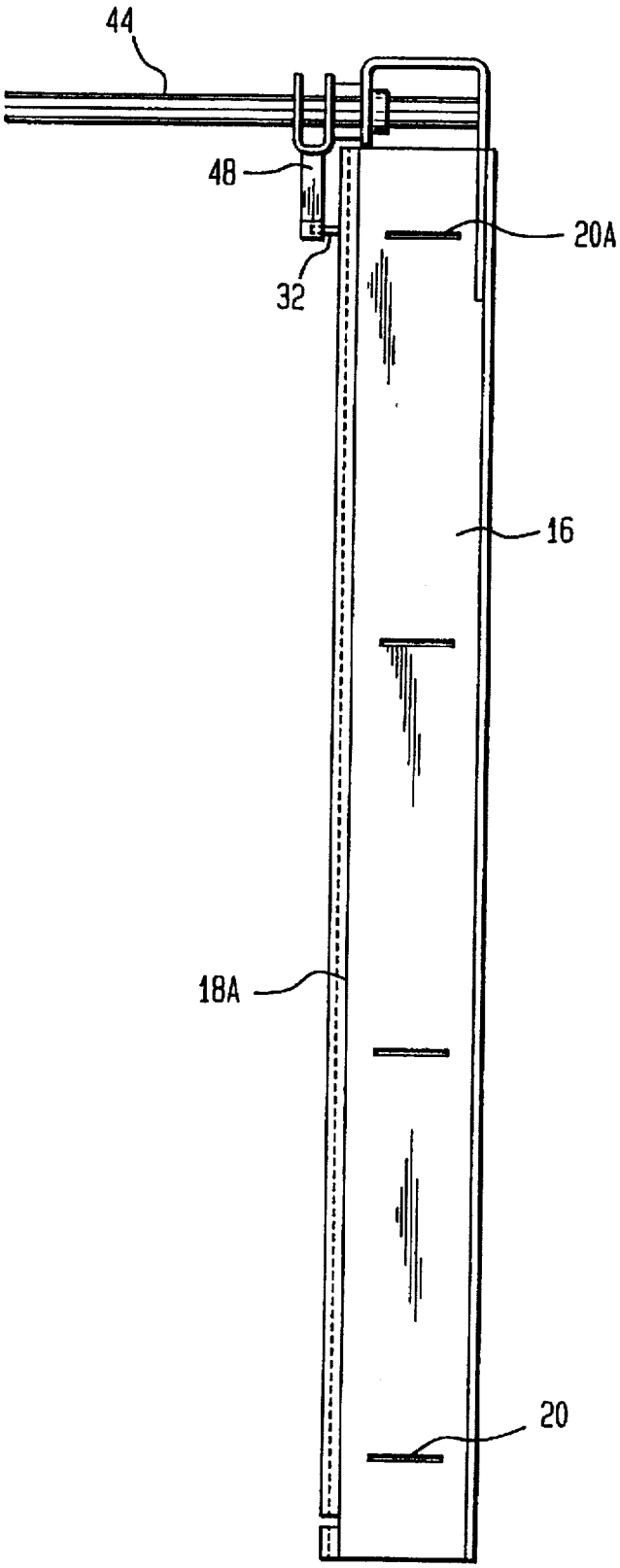
FIGS. 7G and 7H are, respectively, an isolated side view and an isolated front view of an alternative embodiment of the lock arrangement according to the present invention.
Figure 7H:
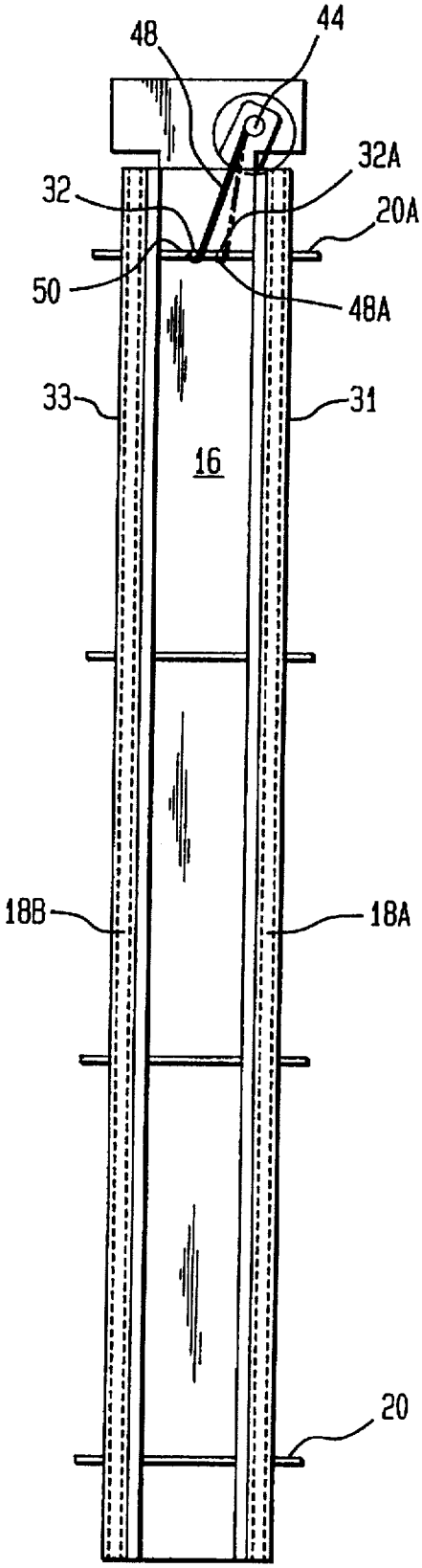

An alternative embodiment of the locking mechanism is illustrated in FIGS. 7G and 7H. Referring to FIG. 7G, an isolated side view of support rail 16 is shown along with lock rod 44 which extends from the front of cabinet 10. As shown in FIG. 1, the lock rod 44 terminates at lock cylinder 46 which may be in one of two angular positions, a "locked" position and an "unlocked" position. As is conventional with lock cylinders, a key is necessary to change the lock cylinder 46 from the "locked" position to the "unlocked" position.

The effect of the two different angular orientations of lock rod 44 is best shown with reference to FIG. 7H. FIG. 7H is an isolated front view which corresponds to the side view of FIG. 7G. As shown, the support rail 16 has locking bars 18A, 18B (shown in broken lines) disposed within its U-shaped cavity along its vertical length. Top shuttle 20A is shown near the top of support rail 16, with a locking pin 32 extending therefrom. The locking pin 32 is preferably an integral portion of the shuttle 20A material.

Rigidly affixed to the end of lock rod 44 is locking spring 48, which is substantially J-shaped and extends, generally, toward the bottom of cabinet 10. The connection between lock rod 44 and locking spring 48 is such that as the lock rod 44 is rotated by the turning of a key in key cylinder 46, the locking spring 48 is moved in an angular direction toward the locking pin 32. A notch 50 of the J-shaped locking spring 48 engages locking pin 32 as the spring 48 is rotated.

The rotation of locking spring 48 results in a force being applied to the locking pin 32 by the spring 48. The force on upper shuttle 20A (given the stiffness of locking spring 48) is sufficient to overcome the bias of springs 26 on the shuttles 20. This causes the shuttle 20A to shift to the position shown in FIG. 3B. As upper shuttle 20A shifts to the FIG. 3B position, the locking bars 18A, 18B pivot and, consequently, cause all of the other shuttles 20 disposed along the support rail to also shift to the orientation of FIG.

3B. In this position, any of the drawers which are in the closed position will be locked by the engagement of locking bar 18A with their camplate 34, in the manner shown and described in conjunction with FIG. 6.

In addition to locking the closed drawers, the locking mechanism of the cabinet 10 also allows any open drawers which are subsequently closed to also be locked in the same manner. Although the spring bias of locking spring 48 is sufficient to maintain the locking bars 18A, 18B in the orientation shown in FIG. 6, the bias of spring 48 may be temporarily overcome by the force of a camplate 34 of a drawer being closed. In the same manner shown in FIGS. 5A–5C, the camming surface 38 will force locking bar 18A to pivot temporarily to the position shown in FIG. 3A. However, the constant bias of locking spring 48 against upper shuttle 20A will cause the locking bars to return to the position shown in FIG. 6 once the camming surface 38 has cleared the end of locking bar 18A. At that time, the locking bar 18A will prevent the opening of the previously-opened drawer, as it does with the other drawers.

When the lock rod 44 is rotated in the other direction (i.e. with a key in cylinder 46), locking spring 48 pivots counterclockwise toward first side 31 of support rail 16. The force provided by locking spring 48 against upper shuttle 20A is sufficient to shift the shuttle into the position shown in FIG. 3A, along with the other shuttles 20 of the cabinet. In the position shown in FIG. 3A, locking pin 32 is located in the position 32A shown in broken lines in FIG. 7H. While the vertical position of locking pin 32 does not change in the shifting to position 32A, the change in angular orientation of spring notch 50 results in its movement to the position shown by the broken line spring representation 48A depicted in FIG. 7H. Movement of the spring 48 to this position results in the notch 50 disengaging from locking pin 32A. As such, the drawers are then "unlocked" and are free to function according to the interlocking mechanism shown in FIGS. 5A–5F.

While the preferred embodiment shows a manual "lock and key" type arrangement for actuating the locking mechanism of the cabinet, those skilled in the art will recognize that other types of actuators may also be used. In fact, because only light gauge components are needed for the locking bars, the present invention is particularly suited for the use of electrical actuating systems, such as those using a solenoid. Because there is less inertia in the locking bars than in prior art systems, a relatively small solenoid may be used, which requires a correspondingly small amount of electrical power to operate. Thus, for modem actuating systems using components such as radio frequency (RF) detectors and decoders, or magnetic card readers, a notable reduction in bulk and expense is achieved.

Figure 8A:
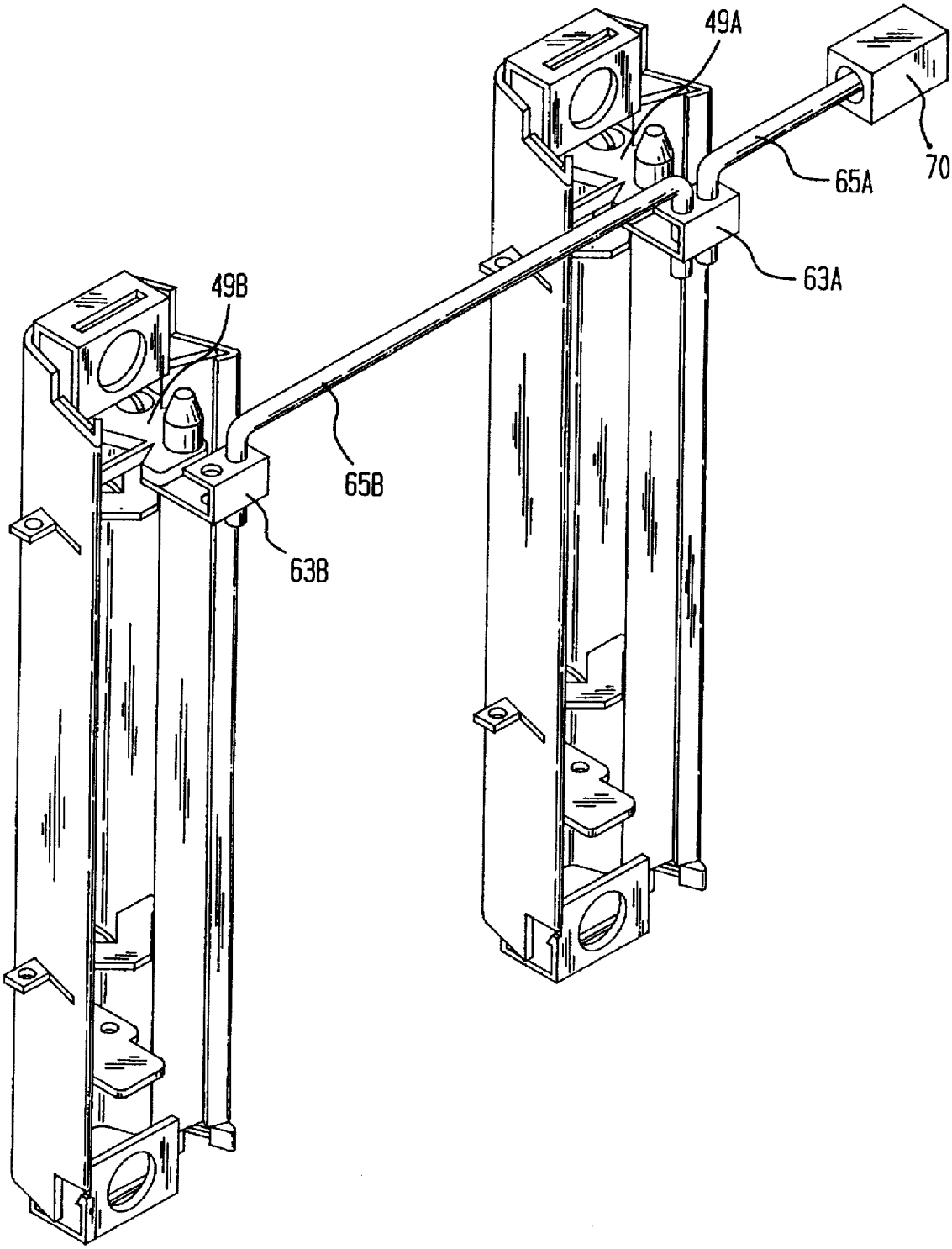
FIG. 8A is an isometric view of a portion of a preferred embodiment of a gang-locking assembly of the present invention.

In an alternative embodiment of the present invention, a ganglock system is implemented to allow a series of adjacent cabinets to be simultaneously secured (locked) with one actuating system such as a lock or solenoid. Referring to FIG. 8A, a preferred embodiment of the ganglock system of the present invention is illustrated. The ganglock system generally includes one or more actuating rods 65A, 65B (generally and collectively referred to as actuating rods 65), and one or more actuating rod coupling plates 63A, 63B (also generally referred to as coupling plates 63). Each coupling plate 63 is fixedly attached to a bottom surface of an associated pivot block 49 beneath the tapered cylinder 47. The coupling plates 63 extend away from the respective pivot block 49, and provide means for pivotally securing up to two actuating rods 65 to gang neighboring cabinets.

In the preferred embodiment, the actuating rods have a length appropriate for the distance between the pivot blocks of neighboring cabinets. Each end of the actuating rod 65 is curved, with the curved end portion configured to attach to the coupling plate 63. The coupling plates 63 have circular channels for removably and pivotally receiving the curved end portion of the actuating rod 65.

In the configuration illustrated in FIG. 8A, two neighboring cabinets are ganged such that they may be secured by a single actuation means 70. A coupling plate 63A is attached to pivot block 49A, while a coupling plate 63B is attached to pivot block 49B of a neighboring cabinet. Actuating rod 65A couples actuating means 70 with coupling plate 63A, while actuating rod 65B links coupling plate 63A with coupling plate 63B.

When the gang-locking mechanism is in an unlocked position as shown in FIG. 8A, the drawers of the cabinets may be opened and closed, subject only to the drawer interlocking mechanism of each of the cabinets.

To gang-lock the cabinets, actuator 70 retracts actuating rod 65 in a direction away from the cabinets, moving it such that, through cooling plate 63A, it causes the pivot block 49A to rotate in a counterclockwise direction about its pivot point to eventually arrive at its locked position. Since actuating rod 65B couples the two pivot blocks illustrated in FIG. 8A, the force applied by actuator 70 is transferred to pivot block 49B, causing it to also pivot into its locked position. To unlock the cabinets, the actuator 70 is used to move the actuating arms 65 towards the cabinets to cause the pivot blocks to rotate in a clockwise direction into their respective unlocked positions, as described above.

It should be noted that the actuating rods and coupling plates may be pivotally coupled in any other known manner. It should also be noted that any combination of master/slave cabinets can be arranged, each with or without a locking mechanism and associated cylinder 46.

Figure 8B:
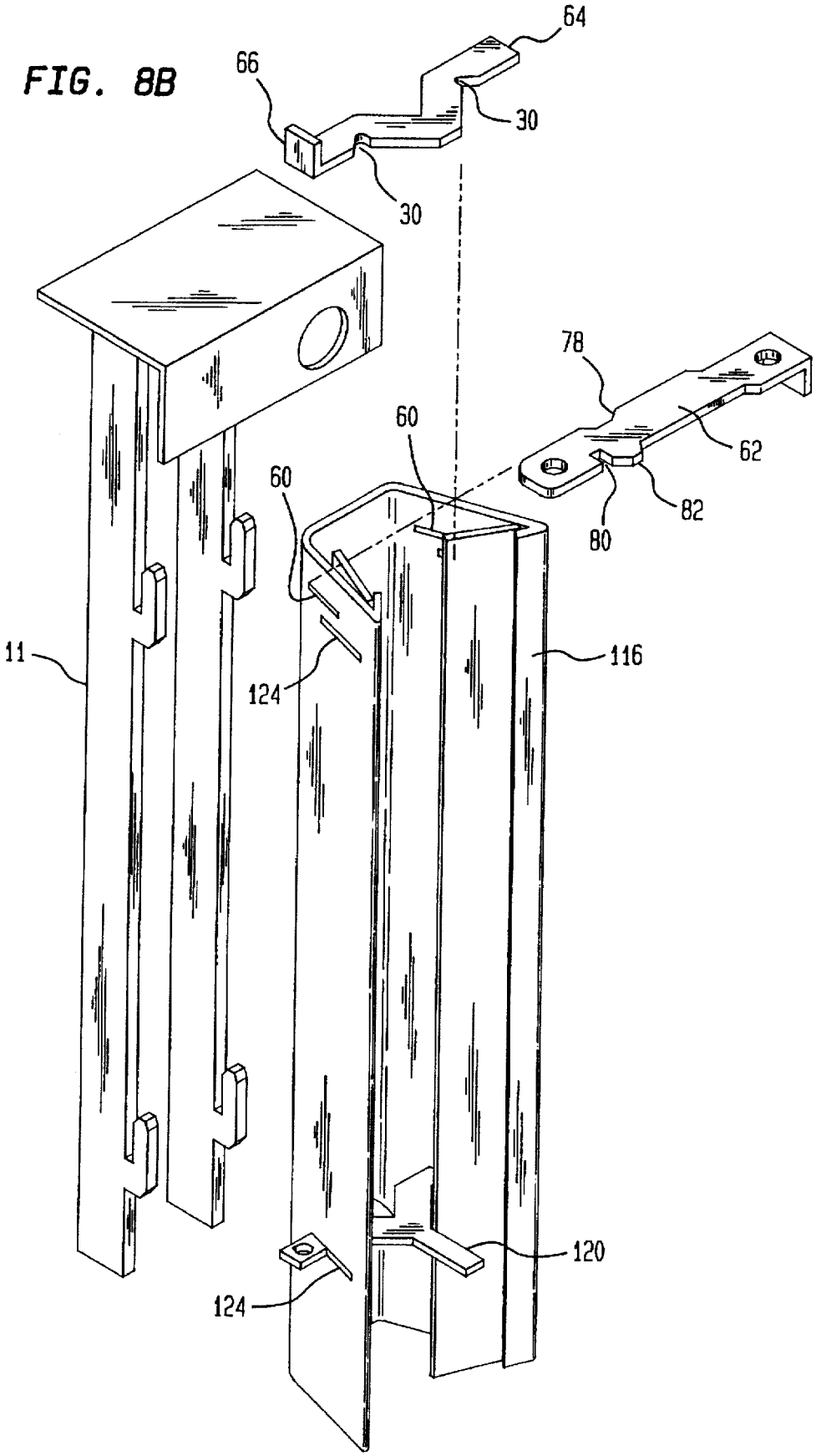
FIG. 8B is an isolated, exploded isometric view of a portion of an alternative gang-locking assembly of the present invention.

An alternative embodiment of the gang locking system is illustrated in FIG. 8B. Referring to FIG. 8B, a support rail 116 is substantially the same as the FIG. 1 embodiment, and is secured to a mounting bracket 11 of a cabinet of drawers. The support rail 116 of FIG. 8B, however, has a pair of opposing slots 60 in addition to slots 124 within which the shuttles reside. The slots 60 are located near the top of the support rail, and receive a gang-locking slide 62. Slide 62 is shown exploded away from the support rail in FIG. 8B but, when mounted in slots 60, it is positioned slightly above a top shuttle of the support rail and somewhat closer to a back portion of the support rail 116.

In FIG. 8B, a special gang-locking shuttle 64 is located in the top pair of slots 124 of the support rail for each of a plurality of cabinets to be gang-locked. The shuttle 64 has notches 30 for receiving the locking bars of the cabinet, just as do the other shuttles 120 of the system. However, a left side of shuttle 64 is bent upwards to provide an engagement tab 66, which extends upwards past the vertical level of slots 60. The shuttle 64 is shown exploded from the support rail 116 in FIG. 8B to more clearly depict its structural elements. The operation of the alternative embodiment may be more clearly understood with reference to FIGS. 9A and 9B.

Figure 9A:
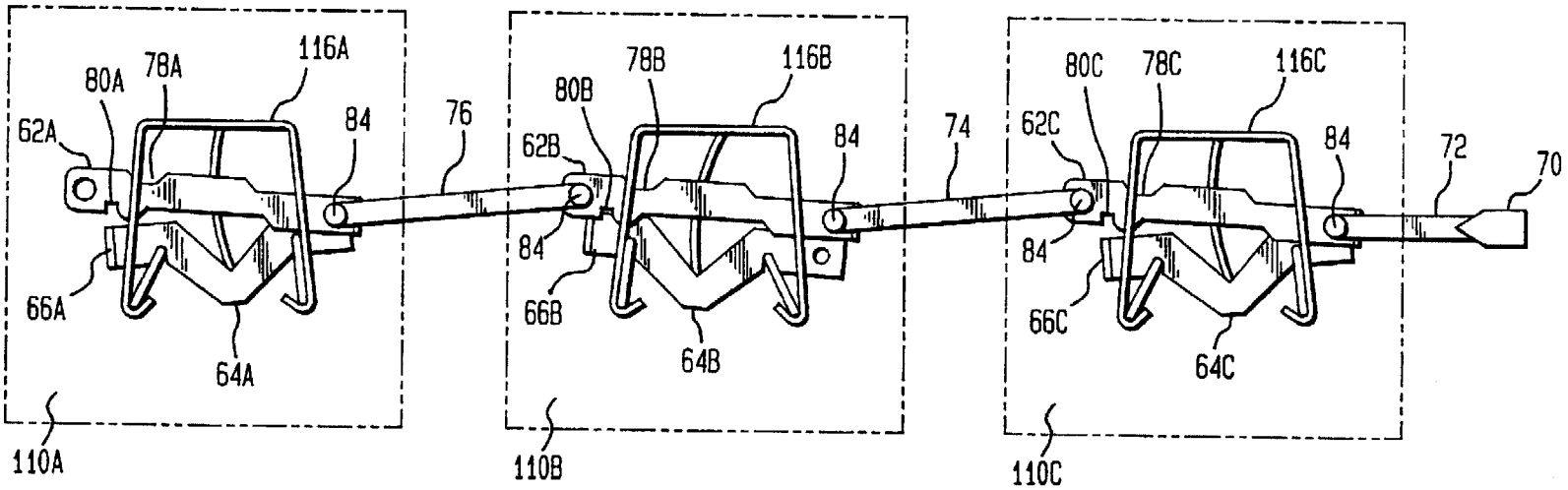
FIGS. 9A and 9B are schematic top views showing, respectively, two different relative positions of a gang-locking mechanism of an alternative embodiment of the present invention.

FIG. 9A schematically depicts three cabinets 110A, 110B, 110C, each of which may be gang-locked by a single actuator 70. In FIG. 9A, the gang-locking mechanism is in an "unlocked" position and the drawers of the cabinets may be opened and closed, subject only to a drawer interlocking mechanism such as that discussed previously. The schematic view of FIG. 9A is from above the top shuttle 64A, 64B, 64C of each of the cabinets 110A, 110B, 110C. With the gang-locking mechanism in the unlocked position, each of the top shuttles 64A, 64B, 64C is free to move between the two extreme positions of the locking bars used by the drawer interlocking system of its respective cabinet. In FIG. 9A, cabinets 110A and 110C have their locking bars in a position which indicates that all the drawers of the cabinets are closed. However, cabinet 110B shows its locking bars in a position which indicate that one of the drawers of the cabinet 110B is open. In either of these two positions, the top shuttle 64A, 64B, 64C of each cabinet is free to move without interference from slide 62A, 62B, 62C.

To gang-lock the cabinets 110A, 110B, 110C, actuator 70 applies a force on linkage 72, moving it further into cabinet 110C. Linkage 72 is connected to slide 62C which is, in turn, connected to slide 62B by linkage 74. Slide 62B is also connected to slide 62A by linkage 76. Thus, the force applied on slide 62C by linkage 72 is translated to each of the other slides 62B and 62A. The force from actuator 70 causes each slide 62A, 62B, 62C to shift its lateral position in the slots 60 of its respective support rail 116A, 116B, 116C. This movement is in a leftward direction relative to the orientation shown in FIGS. 9A and 9B.

Figure 9B:
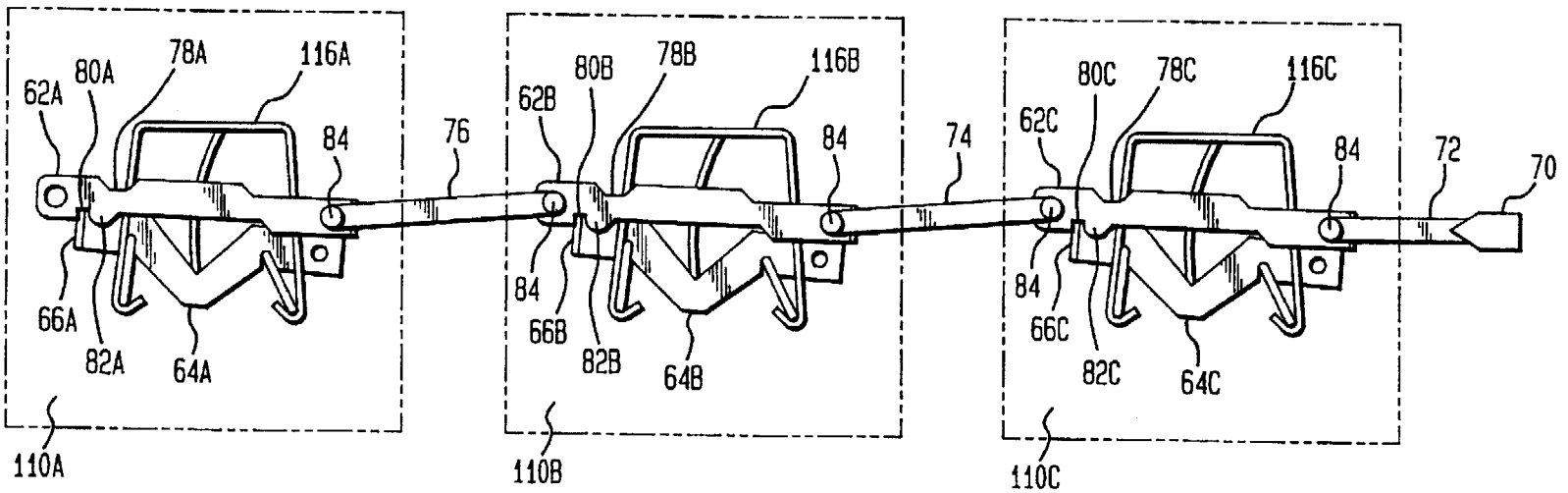

As the gang-lock slides 62A, 62B, 62C move through their respective support rails 116A, 116B, 116C, a surface 78A, 78B, 78C of each slide contacts the rearmost portion of the slot 60 and the left-hand side of its respective rail. The diagonal orientation of the surface 78A, 78B, 78C relative to the direction of the force moves a left-hand side of each slide toward a front of its respective cabinet 110A, 110B, 110C. This leftward and frontward motion of each slide continues until the tab 66A, 66B, 66C of each top shuttle 64A, 64B, 64C is engaged by a notch 80A, 80B, 80C of its adjacent slide 78A, 78B, 78C. Because the tab 66A, 66B, 66C extends vertically above the plane in which its adjacent slide 78A, 78B, 78C resides, (while the remainder of the top shuttle is below this plane), the top shuttle 64A, 64B, 64C is limited in its lateral movement by the location of the tab 66A, 66B, 66C in its respective notch 80A, 80B, 80C. Further movement of the slides 78A, 78B, 78C in a leftward direction force the top shuttle 64A, 64B, 64C to also move in a leftward direction, correspondingly pivoting the locking bars of each cabinet into the locked position, as shown in FIG. 9B. This position of the slides and top shuttles may be retained by providing a restricting means at the location of the actuator 70, such as a lock and key which holds the linkage 72 in its leftmost position.

In FIG. 9B, each of the cabinets 110A, 110B, 110C has its locking bars in a position which prevents the opening of any drawers in the cabinet, in the same manner as that of FIG. 6. In order to unlock the cabinets, the actuator 70 is used to move linkage 72 in a rightward direction, relative to the orientation of FIGS. 9A and 9B. This force translates through each of the slides 78A, 78B, 78C via linkages 74 and 76. As the slides move in a rightward direction, a surface 82A, 82B, 82C of each engages a frontmost portion of the slot 160 in the left side of its respective support rail 116A, 116B, 116C. Because this surface 82A, 82B, 82C is diagonal relative to the direction of the force, the rightward movement of the slides 78A, 78B, 78C causes the left side of each slide to move towards the rear of its respective cabinet 110A, 110B, 110C. The combination of the rightward and the rearward movement of the slides result in corresponding movement in the top shuttles 64A, 64B, 64C. The translation of force is sufficient to move the shuttles past a centerpoint of the spring bias which influences the position of the locking bars, such that the locking bars return to the unlocked position shown in cabinets 110A and 110C of FIG. 9A. Meanwhile, the left-hand side of each slide 78A, 78B, 78C moves rearward, and the tabs 66A, 66B, 66C are disengaged from their respective notches 80A, 80B, 80C (after the spring bias centerpoint has been passed). Thus, the slides 78A, 78B, 78C once again move clear of the path of travel of the top shuttles 64A, 64B, 64C and leave each cabinet 110A, 110B, 110C with its locking bars in the unlocked position, ready for use subject to the drawer interlocking system.

The connection of linkages 72, 74, 76 and slides 78A, 78B, 78C may be accomplished using pivotable joints such as holes and pivot pins 84. The actuator 70 may be any type of well-known actuator, such as a spring-biased lock cylinder which forces linkage 72 further into cabinet 110C as the cylinder is pressed against the bias of its spring. The gang-locking may also be electrically controlled, with the actuator 70 being a solenoid. As mentioned above with regard to the single cabinet locking system of FIGS. 7A through 7H, the lighter gauge materials of the present invention lend themselves well to the use of a solenoid system (which may have a card reader or RF detector as an electronic "lock"). Such an electronic system can function with a solenoid that is relatively small in size and consumes a relatively small mount of electrical power. It will also be understood by those skilled in the art that any of a variety of other types of actuators may be used without departing from the scope of the invention.

Figure 10:
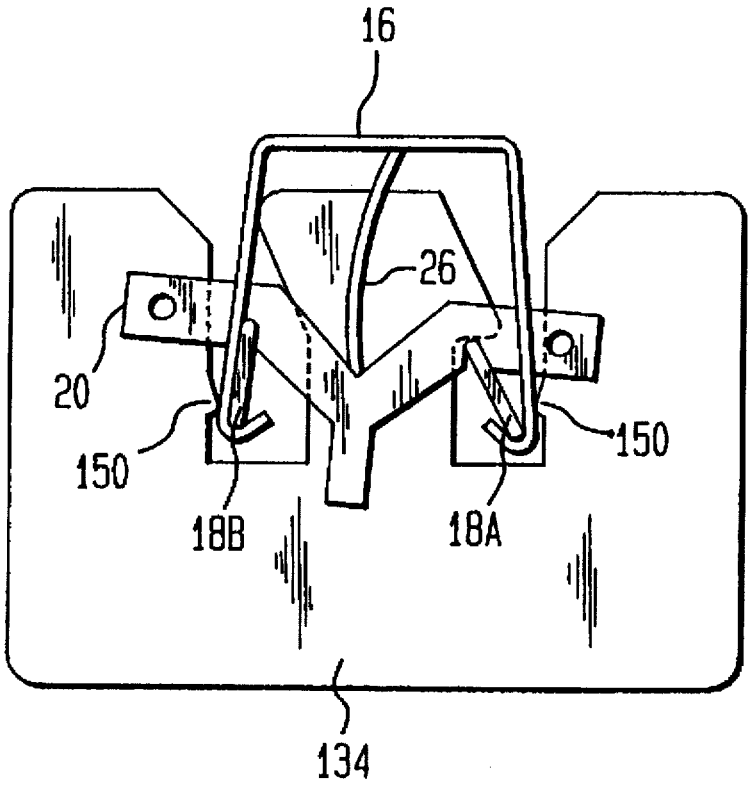
FIG. 10 is an alternative embodiment of the present invention wherein ramps are formed on the inside surface of the camplates to prevent the drawers from bouncing open.

An additional embodiment of the present invention is shown in the cross sectional top view of FIG. 10. Support rail 16, shuttle 20 and locking bars 18A, 18B are substantially the same as those shown in FIG. 6. However, the camplate 134 differs from the camplate 34 of FIG. 6 in that ramps 150 are formed in the inside edges of the camplate 134. The minimum distance between the two ramps 150 is smaller than the maximum width of the support rail in its normal, relaxed state. Thus, as the drawer to which the camplate is attached is closed, contact between the ramps and the support rail 16 slightly compresses the support rail.

The ramps 150 are positioned such that, when the drawer is in a fully closed position (as shown in FIG. 10), the peaks of ramps 150 have passed the lips 28 of the support rail, where the width of the support rail is a maximum. In this position, the support rail has passed its point of maximum compression, and has expanded into the wider separation provided to the front side of the ramps. Thus, to open the drawer, a force must be provided which is sufficient to again compress the support rail when the ramps 150 pass by lips 28 as the drawer, and camplate, move toward the front of the cabinet.

The additional force necessary to open the drawers in the ramp embodiment of FIG. 10 tends to keep the drawers from bouncing open from a closed position when the drawer is slammed shut, as is often the case. This feature replaces prior art systems which use a pit at the end of the drawer guides on which a bearing of the drawer slides. As shown in FIG. 10, the preferred shape of each ramp 150 is with a relatively gradual slope on the side of the ramp facing the back of the cabinet and a relatively steep slope on the side of the ramp 150 facing the front of the cabinet. This shape results in a greater instantaneous force being required to move the camplate 134 ramps past the lips 28 of the support rail 16 when the drawer is being opened than is required when the drawer is being closed. That is, the mechanical advantage provided by the gradual slope of each ramp 150 is greater than that on the steep slope. Therefore, the drawer tends to slide closed rather easily, while requiring a greater force to be moved into the open position.

While the invention has been particularly shown and described with reference to a preferred embodiment thereof, it will be understood by those skilled in the art that various changes in form and detail may be made therein without departing from the spirit and scope of the invention as defined by the appended claims.

I claim:

1. A storage cabinet comprising:

a plurality of drawers each of which is movable between an open position and a closed position;

a plurality of camplates each attached to one of the drawers and each having a camming surface;

a first locking bar which is engaged by a first camming surface of each of the camplates such that said first locking bar pivots about a first pivot axis from an unlocked to a locked position when one of the drawers is moved to an open position and which, in the locked position, provides an obstruction which prevents drawers in the closed position from being moved to an open position, the first locking bar, in the direction of the pivot axis, having two opposite end portions and an intermediate portion between the two end portions;

a support rail which contacts and supports the intermediate portion of the first locking bar, the support rail restricting lateral movement of the first locking bar, but allowing pivoting movement thereof;

a second locking bar which is engaged by a second camming surface of each of the camplates such that the second locking bar pivots about a second pivot axis substantially parallel to the first pivot axis, the engagement of the second locking bar by the second camming surface causing the second locking bar to pivot from a locked position to an unlocked position when a drawer in an open position is moved to a closed position;

a linkage which links the pivoting motion of the first locking bar and the second locking bar such that the bars pivot between a locked position and an unlocked position in unison;

a locking mechanism comprising a) pivot bar having a locking surface on a first side adjacent to said second locking bar and a contact arm extending from a second side adjacent to said first locking bar;

b) means for pivotally mounting said pivot bar to said support rail; and c) means for rotating said pivot bar about a pivot point between a locked and unlocked position;

wherein said locking surface of said pivot bar engages said second locking bar to secure said second locking bar in the locked position and further wherein said contact arm of said pivot bar engages said first locking bar causing said first locking bar to pivot from the locked position to the unlocked position.

2. A storage cabinet according to claim 1, wherein said means for rotating said pivot bar comprises:

a user-controlled rotating rod;

a rotor fixedly attached to said rotating rod adjacent to said pivot bar; and an engagement block connected to said pivot bar for engaging said rotor as said rotor rotates with said rotating rod.

3. A storage cabinet according to claim 1, further comprising a ganglock system for ganglocking said cabinet with neighboring cabinets, said ganglock system comprising:

an actuator means;

a coupling plate attached to said pivot bar;

a first actuating rod coupled to said actuator means and pivotally coupled to said coupling plate; and additional actuating rods, each coupling said pivot bars of said neighboring cabinets.

4. A storage cabinet comprising:

a plurality of drawers each of which is movable between an open position and a closed position;

a plurality of camplates each attached to one of the drawers and each having a camming surface and one or more side supports;

a first locking bar which is engaged by a first camming surface of each of the camplates such that said first locking bar moves from an unlocked to a locked position when one of the drawers is moved to an open position and which, in the locked position, provides an obstruction which prevents drawers in the closed position from being moved to an open position;

wherein each of said one or more side supports is located adjacent to said first locking bar when the drawer to which the side support is attached is in the closed position, each side support adjacent to said first locking bar limiting any substantial deflection of said first locking bar caused by any lateral forces on said first locking bar;

a second locking bar which is engaged by a second camming surface of each of said camplates, said first locking bar being engaged by a first camming surface of a camplate when said drawer to which said camplate is attached is moved from a closed position an open position and said second locking bar being engaged by said second camming surface of said camplate when said drawer to which said camplate is attached is moved from said open position to said closed position;

a locking mechanism, comprising a) a pivot bar having a locking surface on a first side adjacent to said second locking bar and a contact arm extending from a second side adjacent to said first locking bar;

b) means for pivotally mounting said pivot bar; and c) means for rotating said pivot bar about a pivot point between a locked and unlocked position;

wherein said locking surface of said pivot bar engages said second locking bar to secure said second locking bar in the locked position and further wherein said contact arm of said pivot bar engages said first locking bar causing said first locking bar to pivot from the locked position to the unlocked position.

5. A storage cabinet according to claim 4, wherein said means for rotating said pivot bar comprises:

a rotating rod;

a rotor fixedly attached to said rotating rod adjacent to said pivot bar: and an engagement block connected to said pivot bar for engaging said rotor as said rotor rotates with said rotating rod.

6. A storage cabinet according to claim 4, further comprising a ganglock system for ganglocking said cabinet with neighboring cabinets, said ganglock system comprising:

an actuator means;

a coupling plate attached to said pivot bar;

a first actuating rod coupled to said actuator means and pivotally coupled to said coupling plate; and additional actuating rods, each coupling said pivot bars of said neighboring cabinets.

7. A storage cabinet comprising:

a plurality of drawers, each of which is movable between an open position and a closed position;

a plurality of camplates, each attached to one of the drawers such that the camplates are parallel to one another when the drawers are in a closed position, each camplate having a first camming surface and a second camming surface;

a first locking bar which is engaged by the first camming surface of the camplate of a particular drawer when that drawer is moved from a closed position to an open position, said engagement of the first locking bar resulting in an angular displacement of the first locking bar from a first angular position to a second angular position;

a second locking bar which is engaged by the second camming surface of said camplate of said particular drawer when that drawer is moved from said open position to said closed position, said engagement of the second locking bar resulting in an angular displacement of the second locking bar from a second angular position to a first angular position;

a linkage which links the angular motion of the first locking bar to the angular motion of the second locking bar such that both locking bars move between their respective first angular positions and second angular positions in unison;

a plurality of locking surfaces each movable in unison with an associated camplate, each locking surface of a camplate of a drawer in the closed position being obstructed by the second locking bar when the second locking bar is in its second angular orientation such as to prevent movement of said drawer in the closed position to the open position;

a plurality of support surfaces each rigidly affixed to a drawer and each residing adjacent to one of said first and second locking bars when the drawer to which the plurality of support surfaces is affixed is in the closed position such as to provide a side support which prevents any substantial deflection of the adjacent locking bar;

a locking mechanism comprising a) a pivot bar having a locking surface on a first side adjacent to said second locking bar and a contact arm extending from a second side adjacent to said first locking bar;

b) means for pivotally mounting said pivot bar; and c) means for rotating said pivot bar about a pivot point between a locked and unlocked position;

wherein said locking surface of said pivot bar engages said second locking bar to secure said second locking bar in the locked position and further wherein said contact arm of said pivot bar engages said first locking bar causing said first locking bar to pivot from the locked position to the unlocked position.

8. A storage cabinet according to claim 7, wherein said means for rotating said pivot bar comprises:

a user-controlled rotating rod;

a rotor fixedly attached to said rotating rod adjacent to said pivot bar: and an engagement block connected to said pivot bar for engaging said rotor as said rotor rotates with said rotating rod.

9. A storage cabinet according to claim 7, further comprising a ganglock system for ganglocking said cabinet with neighboring cabinets, said ganglock system comprising:

an actuator means;

a coupling plate attached to said pivot bar;

a first actuating rod coupled to said actuator means and pivotally coupled to said coupling plate; and additional actuating rods, each coupling said pivot bars of said neighboring cabinets.

* * * * *